United States Patent [19]

Cordone et al.

[11] 3,937,266

[45] Feb. 10, 1976

[54] METHOD FOR APPLICATION OF WEAR-RESISTANT COATING

[75] Inventors: Leonard G. Cordone, Allen Park; William A. Donakowski; John R. Morgan, both of Dearborn Heights, all of Mich.

[73] Assignee: Ford Motor Company, Dearborn, Mich.

[22] Filed: Aug. 20, 1973

[21] Appl. No.: 390,131

[52] U.S. Cl. ..... 164/9; 29/527.1; 29/527.3; 164/112; 164/48; 204/9; 204/26

[51] Int. Cl.[2] ..... B22D 19/00; B22D 27/02

[58] Field of Search ..... 164/19, 20, 59, 69, 98, 164/100, 111, 94, 95, 107, 46, 48, 112, 332, 334, 9, 14, 76; 204/4, 48, 49, 52 R, 26, 9; 29/527.1, 527.3, 527.5, 527.6

[56] References Cited

UNITED STATES PATENTS

| | | | |
|---|---|---|---|
| 2,911,708 | 11/1959 | Fike et al. | 29/527.3 |
| 3,061,525 | 10/1962 | Grazen | 204/49 |
| 3,083,424 | 4/1963 | Bauer | 164/112 X |
| 3,098,270 | 7/1963 | Bauer | 164/112 X |
| 3,293,109 | 12/1966 | Luce et al. | 204/38 E |
| 3,616,288 | 10/1971 | Snavely | 204/26 |
| 3,628,237 | 12/1971 | Zeigler | 29/527.6 |
| 3,640,799 | 2/1972 | Stephan et al. | 204/40 |
| 3,797,101 | 3/1974 | Bauer | 164/46 |
| 3,856,635 | 12/1974 | Brown | 204/9 |
| 3,864,815 | 2/1975 | Koch | 29/527.3 |

FOREIGN PATENTS OR APPLICATIONS

| | | |
|---|---|---|
| 873,012 | 7/1961 | United Kingdom |

OTHER PUBLICATIONS

"Bonding Cast Iron to Aluminum Castings," *Light Metal Age*, Oct. 1959, p. 17.

"Aluminum Bonded by Diecasting Process," *Steel*, Nov. 30, 1959, pp. 98–100.

"Transplant Coated Aluminum Cylinder Bores," A. F. Bauer, Paper No. 369C, 1961 Summer Meeting, Society of Automotive Engineers, 485 Lexington Ave., New York, N.Y.

*Primary Examiner*—Roy Lake
*Assistant Examiner*—Paul A. Bell
*Attorney, Agent, or Firm*—Joseph W. Malleck; Keith L. Zerschling

[57] ABSTRACT

A method is disclosed for preparing a coated rotor housing useful in a rotary internal combustion engine. A first mandrel is defined from conductive material such as a chrome-bearing steel. The outer surface of the first mandrel is shaped to be the mirror image of the resultant internal surface of the rotor housing; the first mandrel material is passivated preferably by the use of boiling water to form a chrome oxide material on the outer surface to prevent adhesion of surrounding coated materials. A thin, composite-particle wear-resistant coating is electrolytically deposited on to the first mandrel to form an assembly. The wear-resistant coating is preferably comprised of nickel carrying embedded silicon carbide particles. The first mandrel is stripped from the deposited thin coating leaving a self-supporting liner or sleeve, the liner may be used in its unitary form or may be sliced into smaller liner bands for separate processing. The liner is placed about a brother mandrel (identical in shape to the first mandrel, but previously preheated by use in the die-cast machine) and together they are inserted into a die-cast machine. Molten aluminum is supplied to the machine for casting about said liner to define a complete housing construction, the liner offering high wear-resistance.

11 Claims, 2 Drawing Figures

SMOOTHNESS PROFILE OF EXPOSED LINER SURFACE

METHOD FOR APPLICATION OF WEAR-RESISTANT COATING

BACKGROUND OF THE INVENTION

There are many commercial methods for preparing rotor housings for a typical rotary internal combustion engine. One pertinent method comprehends the preparation of a core surface which is the mirror image of the intended surface of the rotor housing. The core is flame spray coated with a material, such as plain carbon steel, to form a relatively thick and substantially porous self-fused coating on the mandrel. Material selection for the flame spray is limited because the material must attain adherency to the ultimate housing (usually aluminum) which will surround the coating. The spray coating and mandrel together are transferred to a die-casting machine where massive aluminum is cast thereabout to form an integral composite. This is sometimes referred to as the "transplant" method. The mandrel and coating must be preheated prior to introduction to the die-casting machine. Following the complete aluminum die-cast process, the core is stripped from the coating liner to leave an interiorly smooth resultant rotor housing. The principal drawbacks of this known transplant technique are: (a) plain carbon steel, not being adequatly wear-resistant by itself, is only effective as a metallurgical intermediate and the liner must further be processed with an additional wear-resistant coating such as chrome to complete the construction, (b) considerable porosity results from flame spray coating technique thereby reducing heat transfer through the housing to the cooling system disposed about the rotor housing, and (c) the mandrel, being subjected to heating and cooling as a result of being placed within the die-casting process, is subjected to early destruction and the smoothness of its outer surface is prematurely destroyed resulting in eventual defects in the surface of liners requiring additional grinding to remove the defects in the coating liner.

A particularly useful material having high wear-resistance is that of an electrolytically deposited base of nickel with embedded silicon carbide particles. Such material has been known for some time for purposes of coating various products, including rotor housings for rotary engines. However, the technique has involved only direct electrolytic deposition, never by way of the transfer technique mentioned above. A significant problem that may have prevented the prior art from combining the art of electrolytic nickel coating with the transfer method is the inability to obtain an adequate bond. Electrolytic coatings are extremely dense, usually having no porosity. Porosity normally accompanys a sprayed coating providing a basis for interlocking and wetting the cast metal thereto which will withstand the severe environment of a rotary internal combustion engine. The prior art has not appreciated the value and technique of utilizing a wear-resistant material as nickel-silicon carbide in combination with the concept of brother mandrels; an initial mandrel has not been used to define a liner, the first mandrel being then removed from the liner and the liner then being placed on a brother mandrel in the die-cast process.

SUMMARY OF THE INVENTION

The primary object of this invention is to provide an improved composite rotor housing having a liner therein formed of a highly wear-resistant material which is bonded to a cast aluminum supporting structure thereabout, the composite housing being characterized by a low-cost method of preparation.

Another object of the invention is to provide a composite rotor housing in conformity with the above object, which further is produced by a method which reduces the destruction of any mandrel utilized in the fabricating method; in more particularly, the method eliminates the necessity for heating up mandrels used to perfect the smoothness of inner surface of the liner thereby insuring that the mandrel surface will not be destroyed by subsequent cyclical heat treatment. The mandrels are formed of a material that can be easily passivated to prevent adherence to a cermet.

Another object of this invention is to provide a method for making a composite rotor housing, the coating being deposited in a sleeve form on an initial mandrel, then the sleeve is subsequently sliced into thin band configurations, each separate configuration being placed upon a brother mandrel for subsequent casting of a supporting aluminum housing therearound.

Yet still another object is the unique selection of a material for electrolytic deposition of a rotor housing liner that may constitute the entire liner and yet be strong enough to be self-supporting in being carried between manufacturing steps without a supporting mandrel.

DETAILED DESCRIPTION

Figure 1:
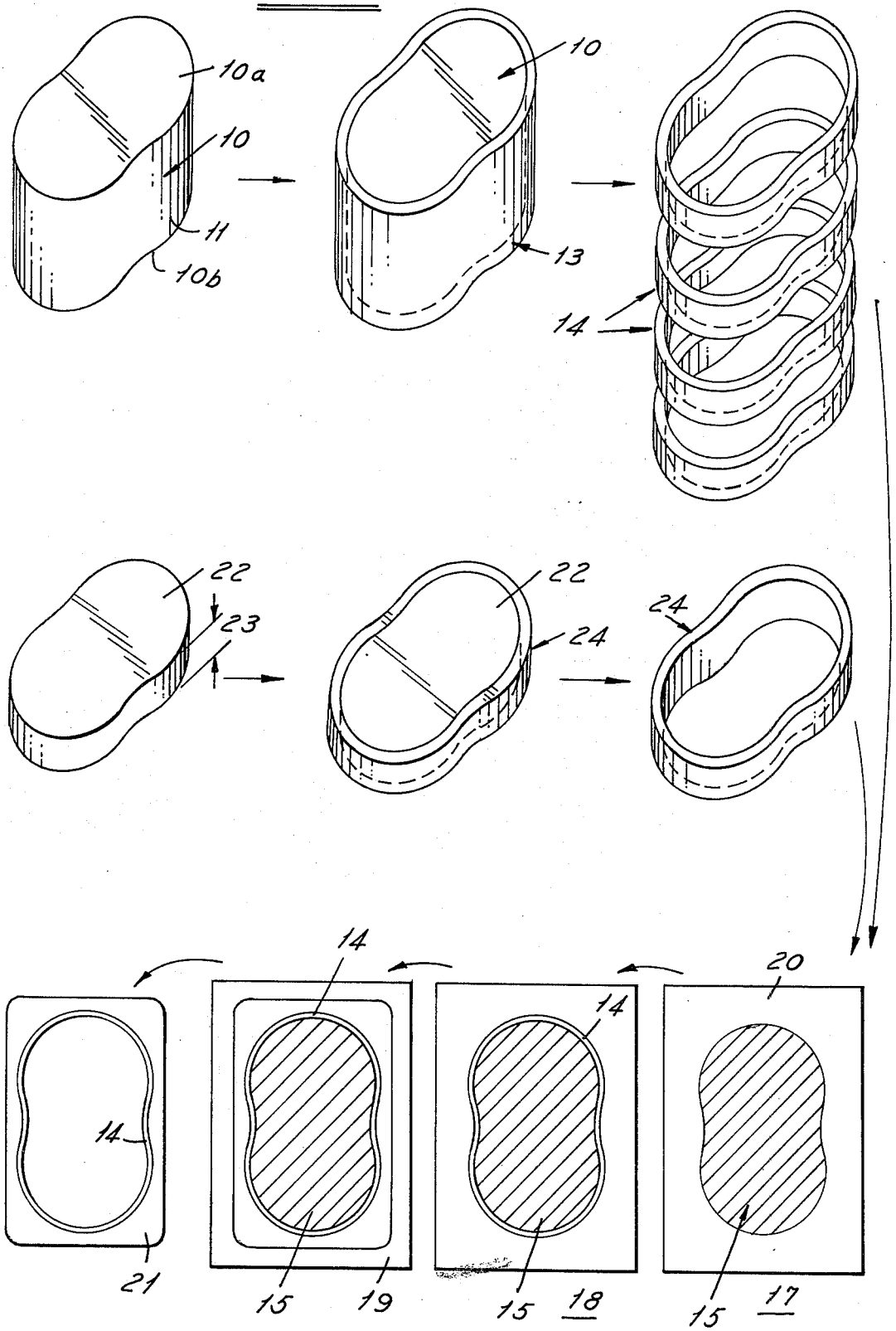
FIG. 1 is a schematic flow diagram illustrating the principal steps of the instant invention.
Figure 2:
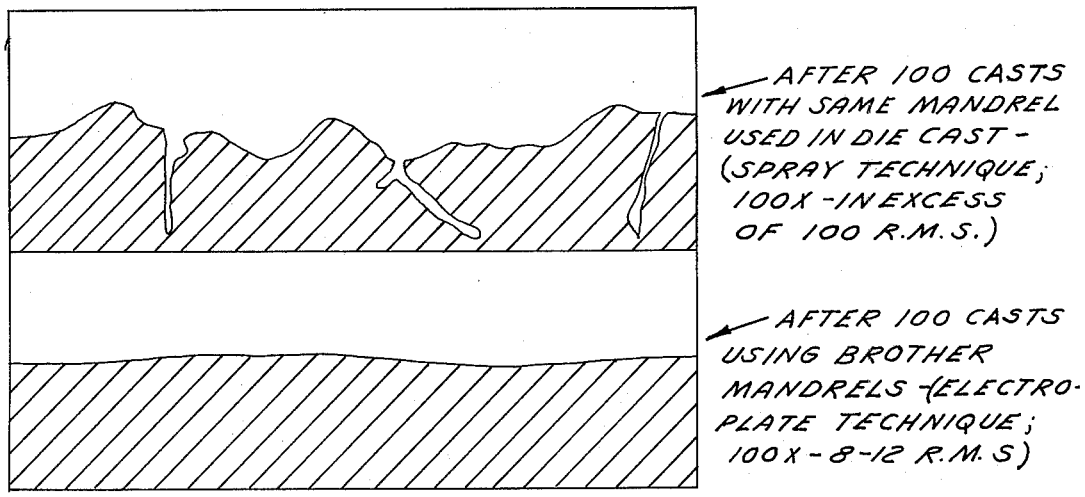
FIG. 2 is a smoothness profile comparing the prior art liner composition with that of the invention composite.

Turning first to the sequence of FIG. 1, a preferred method for carrying out the invention is disclosed. First mandrel 10 is prepared from a suitable core material which is capable of being machined to a very exact complex configuration such as epitrochoid surface 11 as required by the internal surface of a rotor housing of a typical rotary internal combustion engine. The epitrochoid surface 11 is a mirror image of the resultant epitrochoid surface to be structured on the rotor housing. A suitable and necessary material for this purpose would be a chrome-bearing steel having a chromium content in the range of 3–25 percent. The chrome content enables the material to be passivated which facilitates non-adhesion between the mandrel surface 11 and the material to be deposited thereon. In addition, the mandrel may be tapered in a direction from one end 10*a* to the other end 10*b* of the mandrel. Here the mandrel is defined as a rather elongated element wherein the width of surface 11 is much greater than the width of the surface to be utilized on the rotor housing. This facilitates definition of a liner which constitutes an elongated sleeve 13, the sleeve then being subsequently broken into separate bands or shapes 14 for eventual use in the rotor housing. The machined surface of mandrel 10 has a surface roughness of 8–12 r.m.s.

Next, the mandrel is placed in an electrolyte for the purpose of electrolytically depositing a coating of nickel with embedded silicon carbide particles. The composition of the electrolyte is not critical, but the following range of ingredients is found to be conveniently controlled: Nickel sulfamate in the range of 200–600 grams per liter; $NiCl_2 - 6\ H_2O$ in the range of 30–70 grams per liter; and $H_3Bo_3$ in the range of 20–40 grams per liter. Silicon carbide, being among the hardest materials, is preferred; in addition it combines high hardness with low cost in a most desirable manner. Other hard particles that may be used include oxides of aluminum or iron, carbides of silicon or tungsten, diamond, and finely dispersed hard metals, such as tungsten, in mixtures of these materials. The hard particles are dispersed in the electrolyte in an amount between 100 to 150 grams per liter and in a particle size between 0 to 10 microns. A PH value for the electrolyte is selected according to other process variables (between 3 and 5) in a conventional manner. The bath temperature may be about 160°F and the current density is critically sequentially staged to be in the range of about 50–100 amps per square foot for a few starting moments of the electrolytic deposition and then eventually raised to 500–1000 amps per square foot. The particles are maintained in suspension in the bath by proper agitation. Electrolytic nickel is the preferred anode material.

The deposited coating must be in the range of 15–25 mils for proper adherency. The coating 13 will have a porosity substantially 0. This is in high contrast to the characteristic of a sprayed coating which has a considerable amount of porosity, at least a minimum of 5 percent. Porosity in such a coating is a penalty because it retards heat transfer and forms a barrier at the very location in the rotor housing where heat must be transmitted. The lack of porosity produces a denser material and accordingly provides greater heat transfer. The electrolytically deposited nickel-silicon carbide is superior in this respect. The thermal conductivity of the deposited coating is 2.6 and has a thermal expansion coefficient of about 4.7 micro inch/°F.

The next step of the process requires that the mandrel be stripped from the coating to define a self-supporting sleeve. This is facilitated by (a) the taper of the mandrel and (b) prior boiling of the mandrel in water so as to passivate the surface and form a chrome-oxide chemical barrier to adhesion. The sleeve, being considerably longer than the width of the rotor housing, is then cut into bands 14 which are of appropriate configuration to fit with each rotor housing. This may be carried out by a gang of carbide cutters arranged to travel about the epitrochoid configuration and slice the sleeve into separate entities (not shown).

A brother mandrel 15 is defined which is an exact copy of the cross-sectional shape of the initial mandrel 10, as shown at 17 assembled to a die 20. The bands 14 are then placed on the brother mandrel 15 as shown at 18. The assembly of brother mandrel 15, die 20 and band 14 is then placed in a die-casting machine 19. The brother mandrel has been previously heated by continuous use in previous die-casting processes and therefore does not need to be cooled or experience drastic thermal changes. The cavity of the die-casting machine is closed and an aluminum based material is cast thereabout to define a cast rotor housing of a shape similar to that as shown schematically at 21. A preferable chemistry for the aluminum material is that containing 9–11 percent silicon to increase the hardness of the aluminum alloy.

To obviate band cutting, the initial mandrel 22 may be formed of a narrower thickness 23. The resultant coating 24 is also narrower and can be placed directly in the mandrel 15 and into the die-cast machine.

The casting material should be selected from the group consisting of aluminum, cast iron. The electrolytically deposited material should be selected from the group consisting of Ni—SiC and other systems employing cobalt or copper as the base material and SiC, tungsten carbide, titanium carbide, or aluminum oxide as the codeposited particulate matter.

We claim as our invention:

1. A method of producing a coated rotor housing for a rotary internal combustion engine, comprising:

a. defining first and second mandrels each having an outer surface complimentary to the resultant internal surface for the rotor housing, b. electrolytically depositing a thin coating of a composite particle wear-resistant material on said first mandrel, c. separating said first mandrel from said coating leaving said coating as an independent unsupported liner, and d. placing said liner about said second mandrel and casting a molten metallic material thereabout whereby the liner and metallic material are both alloyed and mechanically locked together.

2. The method as in claim 1, in which the electrolytically deposited material is comprised of silicon carbide particles suspended in a nickel base.

3. The method as in claim 1, in which the surface roughness of said first mandrel, prior to electrolytic deposition, is in the range of 8–12 r.m.s.

4. A method as in claim 1, in which both said mandrels are comprised of a material, at least at its outer margin, consisting essentially of a chrome-bearing steel.

5. The method as in claim 4, in which said chrome-bearing steel has a chromium content in the range of 3–25 percent.

6. The method as in claim 4, in which said chrome-bearing steel mandrels are passivated prior to either electrolytic deposition or casting.

7. The method as in claim 6, in which said passivation is carried out by the use of boiling water to form a chrome oxide coating on said mandrel.

8. The method as in claim 1, in which said electrolytically deposited material is in the thickness range of 15–25 mils whereby satisfactory adherency is established under operating conditions of the engine.

9. The method as in claim 1, in which the porosity of the liner joined to the aluminum casting thereabout is substantially zero and thermal conductivity of the liner is in the range of 3.0–5.0 micro-inch/°F.

10. The method as in claim 6, in which the first mandrel is tapered along its longitudinal extent to facilitate said separating step in cooperation with said passivation.

11. The method as in claim 1, in which said first mandrel is elongated along an axis parallel to the outer surface of said mandrel to be coated, the liner resulting from said deposition and separation then being sliced into narrower liner bands for use in a plurality of die-cast steps.

* * * * *